US009259627B1

(12) United States Patent
Myers et al.

(10) Patent No.: US 9,259,627 B1
(45) Date of Patent: Feb. 16, 2016

(54) GOLF CLUB HEAD WITH ADJUSTABLE CENTER OF GRAVITY

(71) Applicant: CALLAWAY GOLF COMPANY, Carlsbad, CA (US)

(72) Inventors: Matthew Myers, Carlsbad, CA (US); James A. Seluga, Carlsbad, CA (US); Patrick Dawson, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 40 days.

(21) Appl. No.: 14/498,843

(22) Filed: Sep. 26, 2014

Related U.S. Application Data

(63) Continuation-in-part of application No. 14/173,615, filed on Feb. 5, 2014, now Pat. No. 9,180,349, which is a continuation-in-part of application No. 14/039,102, filed on Sep. 27, 2013, now Pat. No. 8,834,294, which is a continuation of application No. 13/797,404, filed on Mar. 12, 2013, now abandoned, application No. 14/498,843, which is a continuation-in-part of application No. 14/163,946, filed on Jan. 24, 2014, now Pat. No. 9,211,453, which is a continuation-in-part of application No. 13/766,658, filed on Feb. 13, 2013, now Pat. No. 8,790,195.

(60) Provisional application No. 61/657,247, filed on Jun. 8, 2012, provisional application No. 61/684,079, filed on Aug. 16, 2012, provisional application No. 61/665,203, filed on Jun. 27, 2012, provisional application No. 61/746,348, filed on Dec. 27, 2012, provisional application No. 62/052,343, filed on Sep. 18, 2014.

(51) Int. Cl.
*A63B 53/06* (2015.01)
*A63B 53/04* (2015.01)

(52) U.S. Cl.
CPC ..... *A63B 53/04* (2013.01); *A63B 53/0466* (2013.01); *A63B 2053/0491* (2013.01); *A63B 2053/0495* (2013.01)

(58) Field of Classification Search
CPC .... A63B 53/04; A63B 53/0466; A63B 53/06; A63B 2053/0491
See application file for complete search history.

(56) References Cited

U.S. PATENT DOCUMENTS

| | | | | |
|---|---|---|---|---|
| 4,803,023 | A * | 2/1989 | Enomoto | A63B 53/04 264/45.4 |
| 7,824,280 | B2 * | 11/2010 | Yokota | A63B 53/0466 473/334 |
| 8,425,348 | B2 * | 4/2013 | Boyd | A63B 53/0466 473/335 |
| 8,684,863 | B2 * | 4/2014 | Bezilla | A63B 53/06 473/334 |
| 2007/0155529 | A1 * | 7/2007 | Voges | A63B 53/02 473/290 |
| 2009/0118034 | A1 * | 5/2009 | Yokota | A63B 53/0466 473/338 |
| 2013/0324294 | A1 * | 12/2013 | Oldknow | A63B 53/06 473/327 |

* cited by examiner

*Primary Examiner* — Stephen Blau
(74) *Attorney, Agent, or Firm* — Rebecca Hanovice; Michael Catania; Sonia Lari

(57) ABSTRACT

A golf club head with means for adjusting a center of gravity location along more than one axis is disclosed herein. The golf club head comprises one or more adjustable features, including a weight arm for receiving removable weights, e.g., slidable weights or weight screws, and one or more invertible weight cartridges that fit within a tube extending between the golf club head's crown and sole via an interior cavity. The weight arm fits within a rectangular, elongated recess in the sole and permits the golfer to adjust the location of one or more removable weights along its length.

14 Claims, 4 Drawing Sheets

GOLF CLUB HEAD WITH ADJUSTABLE CENTER OF GRAVITY

The present application claims priority to U.S. Provisional Patent Application No. 62/052,343, filed on Sep. 18, 2014, and is a continuation-in-part of U.S. patent application Ser. No. 14/173,615, filed on Feb. 5, 2014, which is a continuation-in-part of U.S. patent application Ser. No. 14/039,102, filed on Sep. 27, 2013, and issued on Sep. 16, 2014, as U.S. Pat. No. 8,834,294, with is a continuation of U.S. patent application Ser. No. 13/797,404, filed on Mar. 12, 2013, which claims priority to U.S. Provisional Patent Application Nos. 61/657,247, filed on Jun. 8, 2012, 61/684,079, filed on Aug. 16, 2012, and 61/665,203, filed on Jun. 27, 2012, the disclosure of each of which is hereby incorporated by reference in its entirety herein. The present application is also a continuation-in-part of U.S. patent application Ser. No. 14/163,946, filed on Jan. 24, 2014, which is a continuation-in-part of U.S. patent application Ser. No. 13/766,658, filed on Feb. 13, 2014, and issued on Jul. 29, 2014, as U.S. Pat. No. 8,790,195, which claims priority to U.S. Provisional Patent Application No. 61/746,348, filed on Dec. 27, 2012, the disclosure of each of which is hereby incorporated by reference in its entirety herein.

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a golf club head having a plurality of adjustable features that allow the club head's center of gravity to be moved along multiple axes.

2. Description of the Related Art

The ability to adjust center of gravity location and weight in the head of golf clubs is useful for controlling performance of the golf club, particularly in wood-type golf clubs such as drivers. The prior art includes several different solutions for adjustable weighting, but these solutions do not optimize weight adjustment because they typically allow for center of gravity (CG) adjustment along only one axis. See, for example, U.S. Pat. Nos. 7,611,424 and 8,016,694. Therefore, there is a need for a weighting mechanism that allows for simple and flexible center of gravity and moment of inertia (MOI) adjustability along more than one axis.

BRIEF SUMMARY OF THE INVENTION

The present invention is a novel way of working with adjustable products. The present invention allows consumers to adjust the center of gravity of a golf club head along both vertical and horizontal axes. The objective of this invention is to provide a plurality of adjustable weights with minimal or no effect on appearance at address while maximizing the ability of the weight to adjust center of gravity height.

One aspect of the present invention is a golf club head comprising a body having a face, a sole, a crown, and a hosel, means for adjusting a center of gravity along a horizontal axis perpendicular to the face, and means for adjusting the center of gravity along a vertical axis.

Another aspect of the present invention is a golf club head comprising a body comprising a face, a crown, a sole, a rear portion, an interior cavity, and a hosel, at least one removable weight, and an elongated weight arm comprising a first end, a second end, and a plurality of openings, wherein a portion of the at least one removable weight is sized to fit within each of the plurality of openings, wherein the sole comprises an elongated recess sized to receive at least a portion of the elongated weight arm, and wherein the elongated weight arm is removably affixed within the elongated recess such that a lower surface of the elongated weight arm is flush with the sole. In some embodiments, the golf club head may further comprise a tube extending between the crown and the sole through the interior cavity and an adjustable weight cartridge sized to fit within the tube, the elongated recess may comprise a through hole, and the tube may be affixed to the sole such that the through hole communicates with an interior of the tube.

In a further embodiment, the golf club head may comprise a hinge disposed at the rear portion of the sole proximate the elongated recess, the second end of the elongated weight arm may comprise a hinge receiver that can be removably affixed to the hinge, and the weight arm may be capable of pivoting around the hinge when the hinge receiver is affixed to the hinge. In another further embodiment, the golf club head may comprise a tube extending between the crown and the sole through the interior cavity and an adjustable weight cartridge sized to fit within the tube, the elongated recess may comprise a through hole, the tube may be affixed to the sole such that the through hole communicates with an interior of the tube, and the first end of the elongated weight arm may comprise a circular through bore that may align with the through hole such that the tube is visible through the circular through bore. In some embodiments, the adjustable weight cartridge may comprise a first end comprising a first material and a second end comprising a second material, and the first material may have a higher density than the second material.

In some further embodiments, the golf club head may comprise a cap screw with external threads, the through hole may comprise internal threads sized to mate with the external threads, and the cap screw may close the through hole. In a further embodiment, the cap screw may comprise a counterbore sized to receive at least one end of the adjustable weight cartridge, and the cap screw may compress the adjustable weight cartridge between the counterbore and an internal surface of the crown when the adjustable weight cartridge is disposed within the tube and the cap screw is fully engaged with the through hole.

In another embodiment, each of the plurality of openings may comprise internal threads, and the at least one removable weight may be a weight screw comprising external threads sized to mate with the internal threads. In an alternative embodiment, each of the plurality of openings may be a through-bore, the at least one removable weight may be a slidable weight comprising a protruding portion, and the protruding portion may be sized to fit within and extend at least partially through each of the through-bores. In a further embodiment, the slidable weight may be sized to fit within the elongated recess at any location along the elongated recess.

In some embodiments, the elongated recess may comprise a first end, a second end, and a small recess disposed in the first end, the first end of the elongated weight arm may comprise a small protrusion sized to fit within the small recess, and friction between the small recess and the small protrusion reversibly fixes the elongated weight arm within the elongated recess. In other embodiments, the elongated recess may extend between the face and the rear portion along an axis perpendicular to the face.

Yet another aspect of the present invention is a wood-type golf club head comprising a composite crown comprising an interior surface, a metal body comprising a face, a sole, and a rear edge opposite the face, a composite tube extending between the sole and the crown through an interior cavity of the golf club head, a weight cartridge comprising a first end comprising a first material and a second end comprising a second material with a lower density than the first material, an elongated weight arm comprising an upper surface, a lower surface, a first end, a second end, and a plurality of threaded openings extending through the upper surface, at least one weight screw comprising external threads sized to mate with one or more of the threaded openings, and a cap screw comprising a head portion, an extending portion comprising external threads, and a counterbore sized to receive at least one of the first end and second end of the weight cartridge, wherein the sole comprises an elongated recess sized to receive at least a portion of the elongated weight arm, wherein the elongated recess comprises least two side walls, a floor, a first end proximate the face, and a second end proximate the rear edge, wherein the floor comprises a first through bore proximate the face and a plurality of second through bores that align with the plurality of threaded openings when the elongated weight arm is disposed within the elongated recess, wherein the tube is aligned with the first through bore such that the first through bore communicates with an interior of the tube, wherein the first through bore comprises a plurality of internal threads, wherein the cap screw is sized to seal the first through bore when the cap screw is fully engaged with the first through bore, and wherein the cap screw presses the weight cartridge against the interior surface of the crown when the weight cartridge is disposed within the tube and the cap screw is fully engaged with the first through bore.

In some embodiments, the elongated weight arm may comprise a first end comprising a circular through-opening and a second end comprising a hinge receiver, the circular through-opening may align with the first through bore when the elongated weight arm is disposed within the elongated recess, the sole may comprise a hinge disposed proximate the second end of the elongated recess, the hinge receiver may be removably affixed to the hinge, and the elongated weight arm may be capable of pivoting around the hinge when the hinge receiver is affixed to the hinge. In a further embodiment, the head portion of the cap screw may comprise a lip portion, the extending portion may be sized to fit through the circular through-opening, and the lip portion may press against the first end of the elongated weight arm when the cap screw is fully engaged with the first through bore. In another embodiment, the at least one weight screw may comprise a head portion, and each of the plurality of second through bores may be sized to receive the head portion. In other embodiments, the lower surface of the elongated weight arm may be flush with the sole, and each of the plurality of threaded openings may be evenly spaced from one another along the elongated weight arm.

Another aspect of the present invention is a wood-type golf club head comprising a face component, a body comprising a crown, a sole, a rear portion, and an interior cavity, a composite tube extending between the crown and the sole through the interior cavity, an elongated weight arm comprising a first end having a small protrusion, a second end having a hinge receiver, and a plurality of through-holes, a weight cartridge comprising a first end comprising a first material and a second end comprising a second material with a lower density than the first material, and at least one slidable weight comprising a weight protrusion, wherein the sole comprises an elongated recess sized to receive the at least one slidable weight and at least a portion of the elongated weight arm, wherein the elongated recess comprises least two side walls, a floor, a first end proximate the face, and a second end proximate the rear edge, wherein the floor comprises a first through bore proximate the face, wherein the tube is aligned with the first through bore such that the first through bore communicates with an interior of the tube, wherein each of the through-holes in the elongated weight arm is sized to receive at least a portion of the weight protrusion, wherein the first end of the elongated recess comprises a small recess sized to releasably receive the small protrusion, wherein the second end of the elongated recess comprises a hinge sized to fit within the hinge receiver, wherein the first end of the elongated weight arm is disposed proximate the face and does not comprise any openings, and wherein the elongated weight arm retains the weight cartridge within the tube and the slidable weight within the elongated recess when the elongated weight arm is fully engaged with the elongated recess. In some embodiments, each of the plurality of through-holes in the elongated weight arm may be approximately rectangular.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
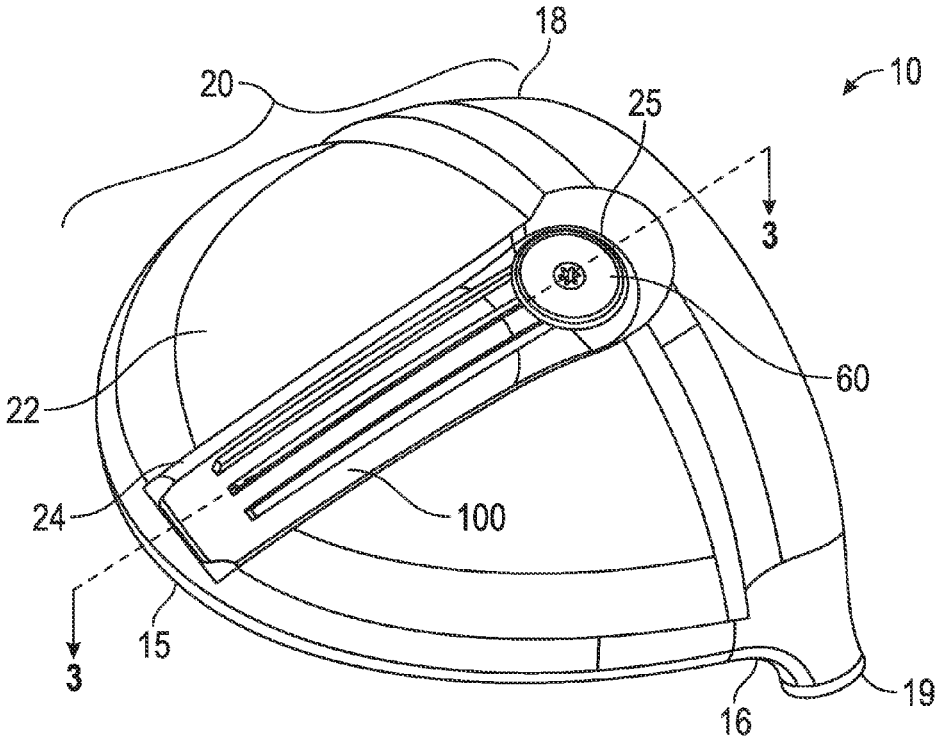
FIG. 1 is a sole perspective view of a golf club head encompassing a first embodiment of the present invention.

The design approaches described herein are based on a construction used in a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup, and particularly with a skeletal metal/composite structure such as the one disclosed in U.S. patent application Ser. No. 14/162,633, the disclosure of which is hereby incorporated by reference in its entirety herein. The weighting embodiments disclosed herein will also work in conjunction with at least one adjustable weight port on the crown of the driver head, and will also work in connection with non-driver clubs, such as fairway woods, hybrids, irons, and putters. Shifting weight as described herein allows for precise control over the golf club head's center of gravity location.

A preferred embodiment of the present invention is shown in FIGS. 1-4. The golf club head 10 comprises a crown 12, a sole 20, a face 14, a rear portion 15, a heel 16, a toe 18, and a hosel 19. The sole 20 comprises first recessed region 22 located at least 0.10 inch away from the face, with a second, approximately rectangular, elongated recessed region 24 extending across the sole perpendicular to the face 14 in a face 14 to rear portion 15 direction. The elongated recessed region 24 intersects with an opening 25 in the sole 20 that connects with a tube 30 that extends between the crown 12 and the sole 20 and is sized to receive an adjustable weight cartridge 40. The opening 25 and tube 30 preferably are disposed at the face-most portion of the elongated recessed region 24, but in alternative embodiments may be disposed anywhere along the length of the elongated recessed region 24, including its rear-most portion. In other embodiments, multiple openings 25 and tubes 30 may be disposed along the elongated recessed region 24 to receive more than one adjustable weight cartridges 40.

As shown in these figures, a weight arm 100 is sized to fit within the elongated recessed region 24 so that it its lower surface 102 is flush with at least the sole 20, or, more preferably, with the first recessed region 22. The weight arm 100, shown in more detail in FIGS. 3 and 4, comprises a first end 105 with a through bore 110, a second end 115 with a hinge receiver 120, and a plurality of openings 130 disposed along the length of the weight arm 100 with equal spacing between each opening 130. In an alternative embodiment, the openings 130 may be spaced from one another at different lengths. The hinge receiver 120 is sized to removably latch onto a hinge 28 disposed at a rear portion 15 of the sole 20, and allows the weight arm 100 to pivot around the hinge 28.

Figure 2:
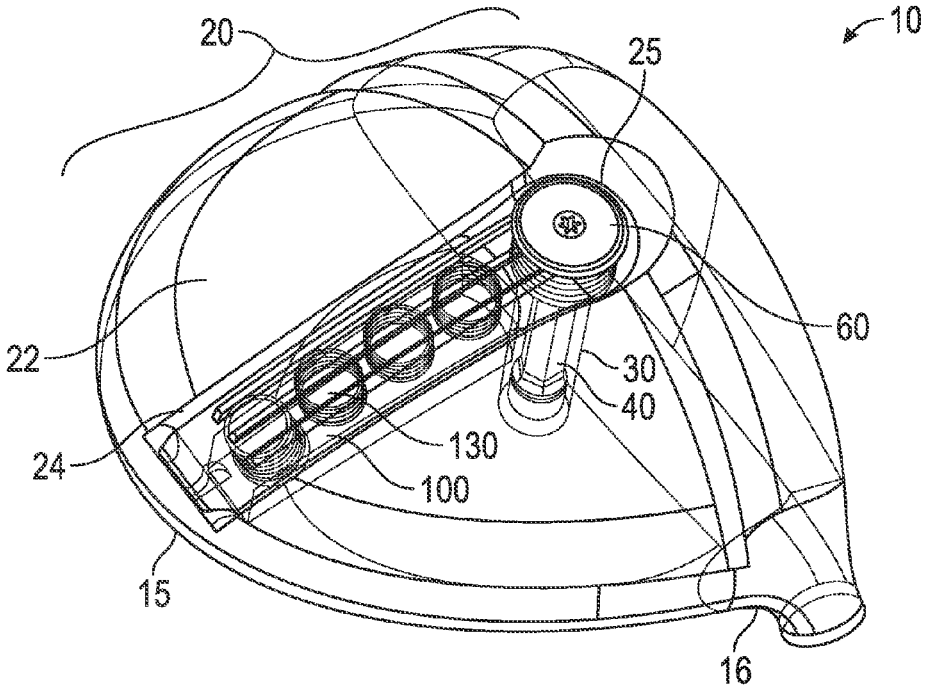
FIG. 2 is a partially transparent view of the embodiment shown in FIG. 1.
Figure 3:
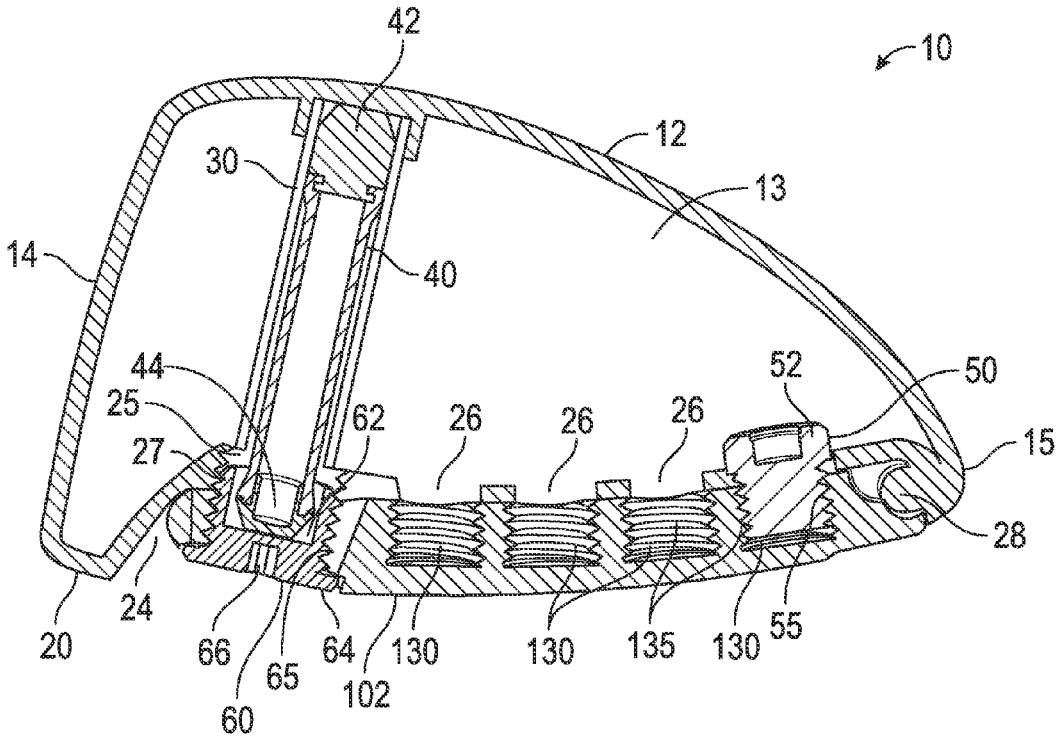
FIG. 3 is a cross-sectional view of the embodiment shown in FIG. 1 along lines 3-3.
Figure 4:
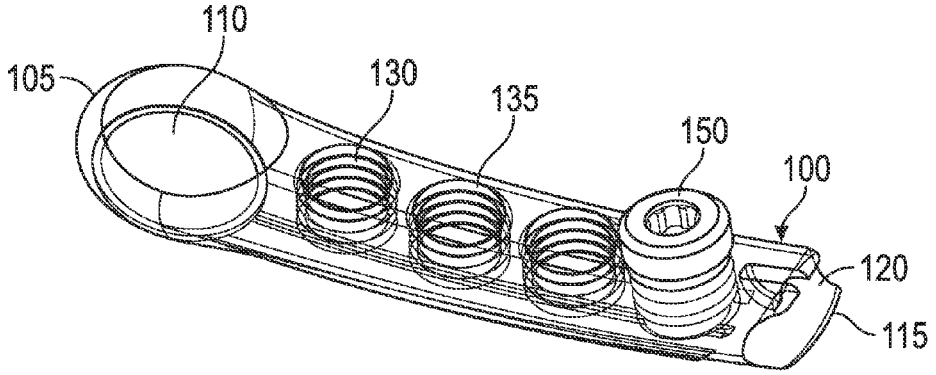
FIG. 4 is a partially transparent view of the weight arm shown in FIG. 1.

In the embodiment shown in FIGS. 2-4, each opening 130 comprises internal threads 135 sized to receive the external threads 55 on a weight screw 50, which can be removed and moved to different openings 130 along the weight arm 100, thus adjusting the face-to-rear location of the golf club head 10 center of gravity. Multiple weight screws 50 can be used with the golf club head 10 so that two or more openings 130 hold a weight screw 50, or the openings 130 can be left empty, depending on the overall weight and mass properties desired by a golfer. As shown in FIG. 3, the elongated recessed region 24 comprises a plurality of through holes 26 sized to receive the head 52 of each weight screw 50, which protrudes into the interior cavity 13 of the golf club head 10 when the weight arm 100 is fully engaged with the golf club head 10 within the elongated recessed region 24. The heads 52 of the weight screws 50 can be longer or shorter in the length than the one shown in the Figures, depending on how significantly a golfer would like to affect the vertical center of gravity location of the golf club head 10. The weight screws 50 can be made of any material known to a person skilled in the art, and may be made of multiple materials.

The through bore 110 of the weight arm 100 is sized and shaped to line up with and fit within the opening 25 in the sole 20 when the weight arm 100 is properly disposed within the elongated recessed region 24. As shown in FIG. 3, the opening 25 in the sole comprises internal threading 27, which mates with external threads 65 on a cap screw 60 sized to fit through the through bore 110 of the weight arm 100 and close up the opening 25. The cap screw 60, which includes a tool receiving region 66 to engage with a screwdriver, Torx® wrench, or other such tool, also comprises a lip portion 64 that extends over the area of the weight arm 100 that surrounds the through bore 110, such that the cap screw 60 retains the first end 105 of the weight arm 100 on the golf club head 10 while the hinge retains the second end 115 of the weight arm 100 on the golf club head 10.

The cap screw 60 also comprises a counterbore 62 that is sized to receive each of the ends 42, 44 of the weight cartridge 40. When one of the ends 42, 44 of the weight cartridge 40 is disposed within the counterbore 62 and the cap screw 60 is fully engaged with the internal threading 27, the cap screw 60 presses the weight cartridge 40 against an internal surface of the crown 12 and retains it securely within the tube 30. If a golfer wishes to reverse the orientation of the weight cartridge 40, he or she need only unscrew the cap screw 60, remove the weight cartridge 40, flip it upside down so that a different end 42, 44 is disposed within the counterbore 62, reinsert the cartridge 40 into the tube and re-screw the cap screw 60 into the opening 25 in the sole 20.

As shown in the Figures, the weight cartridge 40 preferably is cylindrical, and preferably has a first end 42 formed from a denser material or combination of materials than a second end 44. In this embodiment, when a first end 42 of the weight cartridge 40 is inserted into the tube 30, such that the second end 44 is disposed proximate the sole 20, the vertical center of gravity of the golf club head 10 is higher than when the second end 44 of the weight cartridge 40 is inserted into the tube 30 such that the first end 42 is disposed proximate the sole 20. In other words, removing, inverting, and then reinserting the weight cartridge 40 into the tube 30 alters the vertical location of the golf club head 10 center of gravity.

Figure 5:
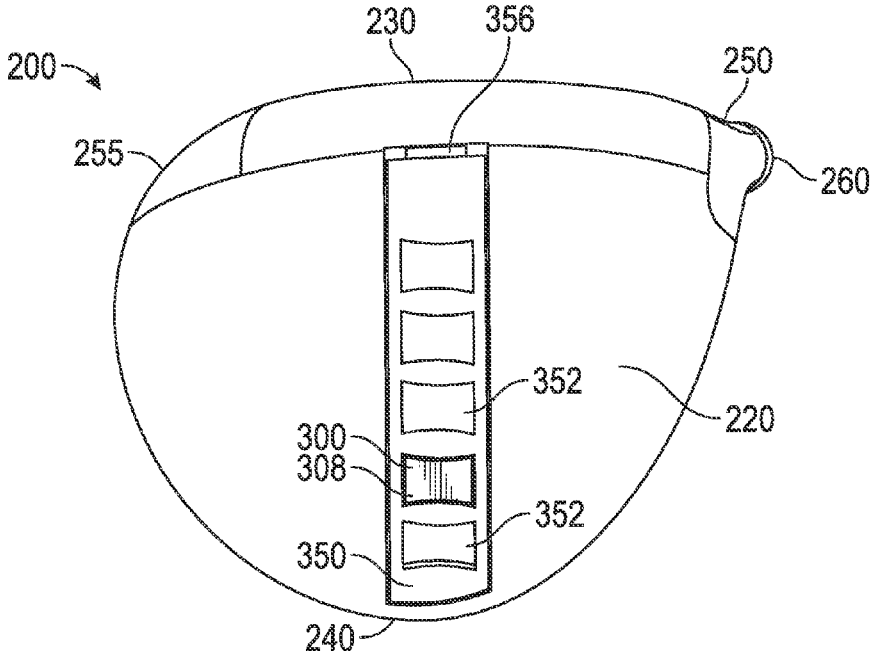
FIG. 5 is a sole plan view of another embodiment of the present invention.
Figure 6:
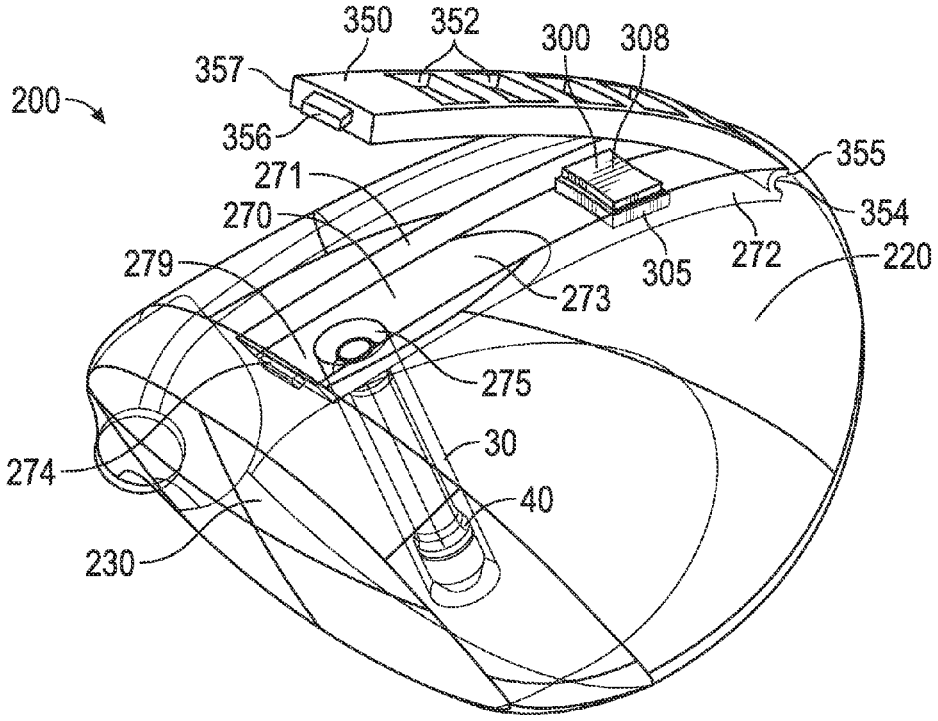
FIG. 6 is a sole perspective, partially transparent, exploded view of the embodiment shown in FIG. 5.
Figure 7:
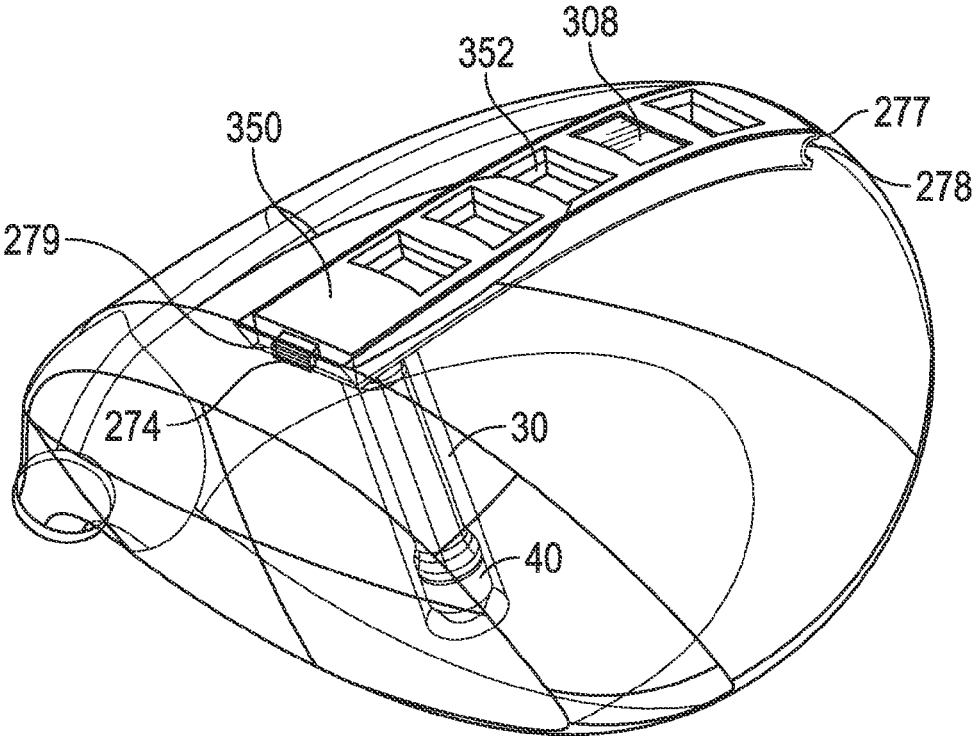
FIG. 7 is a sole perspective, partially transparent, fully assembled view of the embodiment shown in FIG. 5.

An alternative embodiment of the present invention is shown in FIGS. 5-7. In this embodiment, the golf club head 200 comprises the same general structure as the preferred embodiment, with a crown 210, sole 220, face 230, rear portion 240, heel 250, toe 255, and hosel 260. The sole 220 also includes an approximately rectangular, elongated recessed region or channel 270 that extends between the face 230 and the rear portion 240 along an axis perpendicular to the face 230. The channel communicates with an opening 275 in the sole 220 that is connected to a tube 30 extending between the sole 220 and the crown 210 via the interior cavity of the golf club head 200.

The channel 270 is sized to receive a slidable weight 300, which can be slid along any point of the channel 270, and preferably is larger than the opening 275 so that it does not get lodged therein. The channel 270, which includes first and second side walls 271, 272 and a floor 273, may include notches in the side walls 271, 272 to receive one or more edges 305 of the slidable weight 300 so as to retain the weight 300 in the channel 270 when the weight arm 350 is not fully engaged with the golf club head 200. Otherwise, the weight 300 can be sized to fit within the channel 270 such that only friction between its edge 305 and the side walls 271, 272 holds it in place when the weight arm 350 is not engaged with the golf club head 200. In other embodiments, the channel 270 may have any of the characteristics of the channels or slots disclosed in U.S. Pat. Nos. 8,403,771 and 8,529,368 and in U.S. patent application Ser. Nos. 13/591,111 and 13/656,271, the disclosure of each of which is hereby incorporated by reference in its entirety herein.

As shown in these Figures, the weight arm 350 comprises a plurality of through holes 352 through which a central, projecting portion 308 of the slidable weight 300 at least partially extends. The through holes 352 preferably have the same shape as the projecting portion 308 of the weight 300 so that the projecting portion 308 closes off the through hole 352 with which it is engaged. This construction also serves to further secure the weight 300 to the location in the channel

270 that lines up with that particular through hole 352. The weight arm 350 includes a hinge receiver 354 on one end 355 that receives a hinge 278 disposed at the rearward-most end 277 of the channel 270, thus allowing the weight arm 350 to pivot around the hinge 278, and a small protrusion 356 on its other end 357 that snaps into a small recess 274 at the face-most end 279 of the channel 270 to removably secure the weight arm 350, and thus the weight 300, to the channel 270.

In addition to securing the weight 300 at discrete points within the channel 270 that line up with the through holes 352, the weight arm 350 closes off the opening 275 that leads to the tube 30, and thus secures an adjustable weight cartridge 40 within the tube 30 as shown in FIGS. 6 and 7. The underside of the weight arm 350 may include a projection lined up with the opening 275 to place pressure on the adjustable weight cartridge 40 such that it presses against the crown 210 and is securely, but removably, fixed within the tube 30 when the weight arm 350 is secured to the golf club head 200.

In each of the embodiments disclosed herein, the weight cartridge 40 and the tube 30 may have any of the features or characteristics of the embodiments disclosed in U.S. patent application Ser. Nos. 14/039,102 and 14/159,262, the disclosure of each of which is hereby incorporated in its entirety herein. In each of the embodiments disclosed herein, the elongated weight arm preferably is composed of a light-weight material such as composite, plastic, aluminum, titanium, or steel. In each of the embodiments disclosed herein, the weight cartridge 40 permits a golfer to adjust the vertical location of the golf club head 10, 200 center of gravity, while the elongated weight arm permits a golfer to adjust the face-to-rear location of the golf club head 10, 200 center of gravity.

The golf club head 10, 200 of the present invention also preferably includes an adjustable hosel assembly, such that loft, lie, and/or face angle can be changed by adjusting the position of a shaft (not shown) with respect to the hosel 19. The golf club head 10 may have any of the adjustable hosel assembly embodiments disclosed in U.S. patent application Ser. Nos. 13/311,319, 13/436,512, 13/368,569, 13/439,664, 13/367,045, 13/326,156, 13/332,846, 13/408,018, 13/544,037, and 13/660,882, the disclosure of each of which is hereby incorporated by reference in its entirety herein, or in U.S. Pat. Nos. 7,083,529, 7,427,239, 7,465,239, 7,578,749, 8,002,644, 8,096,895, 8,235,840, 8,257,193, the disclosure of each of which is hereby incorporated by reference in its entirety herein.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated by reference in its entirety herein.

The disclosure of U.S. Provisional Patent Application No. 61/684,079 is hereby incorporated by reference in its entirety herein. The disclosure of U.S. Provisional Patent Application No. 61/727,608 is hereby incorporated by reference in its entirety herein. The disclosure of each of U.S. Pat. No. 7,147,573 to DiMarco and U.S. Pat. No. 7,166,041 to Evans is also hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a body comprising a face, a crown, a sole, a rear portion, an interior cavity, and a hosel;

at least one removable weight;

a tube extending between the crown and the sole through the interior cavity;

an adjustable weight cartridge sized to fit within the tube, and an elongated weight arm comprising a first end, a second end, and a plurality of openings, wherein a portion of the at least one removable weight is sized to fit within each of the plurality of openings, wherein the sole comprises an elongated recess sized to receive at least a portion of the elongated weight arm, wherein the elongated recess comprises a through hole, wherein the tube is affixed to the sole such that the through hole communicates with an interior of the tube, and wherein the elongated weight arm is removably affixed within the elongated recess such that a lower surface of the elongated weight arm is flush with the sole.

2. The golf club head of claim 1, further comprising a hinge disposed at the rear portion of the sole proximate the elongated recess, wherein the second end of the elongated weight arm comprises a hinge receiver, wherein the hinge receiver can be removably affixed to the hinge, and wherein the weight arm is capable of pivoting around the hinge when the hinge receiver is affixed to the hinge.

3. The golf club head of claim 2, wherein the first end of the elongated weight arm comprises a circular through bore, and wherein the circular through bore aligns with the through hole such that the tube is visible through the circular through bore when the elongated weight arm is disposed within the elongated recess.

4. The golf club head of claim 3, wherein the adjustable weight cartridge comprises a first end comprising a first material and a second end comprising a second material, and wherein the first material has a higher density than the second material.

5. The golf club head of claim 3, further comprising a cap screw with external threads, wherein the through hole comprises internal threads sized to mate with the external threads, and wherein the cap screw closes the through hole.

6. The golf club head of claim 5, wherein the cap screw comprises a counterbore sized to receive at least one end of the adjustable weight cartridge, and wherein the cap screw compresses the adjustable weight cartridge between the counterbore and an internal surface of the crown when the adjustable weight cartridge is disposed within the tube and the cap screw is fully engaged with the through hole.

7. The golf club head of claim 1, wherein each of the plurality of openings comprises internal threads, and wherein the at least one removable weight is a weight screw comprising external threads sized to mate with the internal threads.

8. The golf club head of claim 1, wherein the elongated recess extends between the face and the rear portion along an axis perpendicular to the face.

9. A wood-type golf club head comprising:

a composite crown comprising an interior surface;

a metal body comprising a face, a sole, and a rear edge opposite the face;

a composite tube extending between the sole and the crown through an interior cavity of the golf club head;

a weight cartridge comprising a first end comprising a first material and a second end comprising a second material with a lower density than the first material;

an elongated weight arm comprising an upper surface, a lower surface, a first end, a second end, and a plurality of threaded openings extending through the upper surface;

at least one weight screw comprising external threads sized to mate with one or more of the threaded openings; and a cap screw comprising a head portion, an extending portion comprising external threads, and a counterbore sized to receive at least one of the first end and second end of the weight cartridge, wherein the sole comprises an elongated recess sized to receive at least a portion of the elongated weight arm, wherein the elongated recess comprises least two side walls, a floor, a first end proximate the face, and a second end proximate the rear edge, wherein the floor comprises a first through bore proximate the face and a plurality of second through bores that align with the plurality of threaded openings when the elongated weight arm is disposed within the elongated recess, wherein the tube is aligned with the first through bore such that the first through bore communicates with an interior of the tube, wherein the first through bore comprises a plurality of internal threads, wherein the cap screw is sized to seal the first through bore when the cap screw is fully engaged with the first through bore, and wherein the cap screw presses the weight cartridge against the interior surface of the crown when the weight cartridge is disposed within the tube and the cap screw is fully engaged with the first through bore.

10. The wood-type golf club head of claim 9, wherein the elongated weight arm comprises a first end comprising a circular through-opening and a second end comprising a hinge receiver, wherein the circular through-opening aligns with the first through bore when the elongated weight arm is disposed within the elongated recess, wherein the sole comprises a hinge disposed proximate the second end of the elongated recess, wherein the hinge receiver can be removably affixed to the hinge, and wherein the elongated weight arm is capable of pivoting around the hinge when the hinge receiver is affixed to the hinge.

11. The wood-type golf club head of claim 10, wherein the head portion of the cap screw comprises a lip portion, wherein the extending portion is sized to fit through the circular through-opening, and wherein the lip portion presses against the first end of the elongated weight arm when the cap screw is fully engaged with the first through bore.

12. The wood-type golf club head of claim 9, wherein the at least one weight screw comprises a head portion, and wherein each of the plurality of second through bores is sized to receive the head portion.

13. The wood-type golf club head of claim 9, wherein the lower surface of the elongated weight arm is flush with the sole.

14. The wood-type golf club head of claim 9, wherein each of the plurality of threaded openings is evenly spaced from one another along the elongated weight arm.

* * * * *